US006164256A

United States Patent [19]

Nakano et al.

[11] Patent Number: 6,164,256

[45] Date of Patent: Dec. 26, 2000

[54] MECHANISM FOR TRANSMITTING THE MOVEMENT OF CAMS

[75] Inventors: Shuuji Nakano; Yoshihito Moriya, both of Nagoya; Hideo Nagaosa; Shinichiro Kikuoka, both of Nishikamo-gun, all of Japan

[73] Assignee: Toyota Jidosha Kabushiki Kaisha, Tokyo, Japan

[21] Appl. No.: 09/369,830

[22] Filed: Aug. 9, 1999

[30] Foreign Application Priority Data

Aug. 31, 1998 [JP] Japan ..... 10-245210

[51] Int. Cl.[7] ..... F01L 13/00

[52] U.S. Cl. ..... 123/90.18; 123/90.5; 74/569

[58] Field of Search ..... 123/90.15, 90.17, 123/90.18, 90.48, 90.5; 74/569

[56] References Cited

U.S. PATENT DOCUMENTS

| | | | |
|---|---|---|---|
| 4,517,936 | 5/1985 | Burgio di Aragona | 123/90.5 |
| 4,693,214 | 9/1987 | Titolo | 123/90.18 |
| 5,870,984 | 2/1999 | Hasegawa et al. | 123/90.18 |
| 5,937,811 | 8/1999 | Motosugi et al. | 123/90.18 |
| 5,988,127 | 11/1999 | Hasegawa et al. | 123/90.18 |
| 5,988,128 | 11/1999 | Moriya et al. | 123/90.18 |

FOREIGN PATENT DOCUMENTS

| | | |
|---|---|---|
| 3-179116 | 8/1991 | Japan . |
| 10-196333 | 7/1998 | Japan . |

OTHER PUBLICATIONS

Titolo, A., "The Variable Valve Timing System–Application on a V8 Engine," 1991, pp. 8–15.

*Primary Examiner*—Weilun Lo
*Attorney, Agent, or Firm*—Oliff & Berridge, PLC

[57] ABSTRACT

A cam follower mechanism for transmitting the movement of a three-dimensional cam to an intake valve. The cam operates a valve through a cam follower mechanism. A valve lifter includes a guide groove having an arcuate cross section. A cam follower is received in the guide groove and engages the cam. The cam follower can pivot about a pivoting axis. The cam follower has an arcuate cross section. The follower includes tapered surfaces, which are inclined less than ninety degrees with respect to the pivoting axis. Contact between the tapered surfaces and the guide groove prevents the cam follower from moving in the direction of the pivoting axis.

14 Claims, 18 Drawing Sheets

MECHANISM FOR TRANSMITTING THE MOVEMENT OF CAMS

BACKGROUND OF THE INVENTION

The present invention relates to a mechanism for transmitting the movement of a three-dimensional cam in accordance with the operation of an internal combustion engine to a valve lifter.

Generally, a variable valve timing mechanism varies the timing of opening and closing an intake valve or an exhaust valve in an internal combustion engine in accordance with the operation of the internal combustion engine. For example, Unexamined Japanese Patent Publication No. 10-196333 describes a variable valve timing mechanism as shown in FIG. 18. The mechanism includes a three-dimensional cam 402. The height of the cam nose of the cam 402 varies continuously in the axial direction. The cam 402 can be moved axially to alter the operating characteristics of the engine. A valve lifter 404 is provided at the end of a valve (not shown) to follow a cam surface 402*a* of the cam 402 through a cam follower 406. When the cam 402 moves axially, the location of contact between the cam follower 406 and the cam surface 402*a* moves axially. As a result, the amount of the valve lift is varied and the valve open-close timing is adjusted.

As shown in FIG. 19, a guide groove 405 is formed on the upper surface 404*a* of the valve lifter 404 and extends in a direction perpendicular to the axis of the valve lifter 404. A cam follower 406, the cross-section of which is semi-circular, is supported in the guide groove 405. Bearing surfaces 406*a* of the cam follower 406 contact corresponding supporting surfaces of the guide groove 405. The angle of the cam surface 402 changes as the cam 402 rotates, and the cam follower moves accordingly. This maintains good contact between the cam 402 and the valve lifter 404.

During the rotation of the cam 402, a force urges the cam follower 406 to move in its longitudinal, or axial, direction Z. Therefore, a stopper is provided between the cam follower 406 and the valve lifter 404 to limit the movement of the cam follower 406 in the longitudinal direction Z. That is, an enlarged portion 406*c* is formed at the longitudinal center of the cam follower 406. A slot 405*a* is formed in the longitudinal center of the guide groove 405. The enlarged portion 406*c* is fitted in the slot 405*a*. The thrust surfaces 406*d* of the enlarged portion 406*c* abut against the thrust surfaces 405*b* of the slot 405*a*, thus limiting the movement of the cam follower 406 in the longitudinal direction Z.

To achieve smooth valve operation, the surfaces of the cam follower 406 must be ground with high precision. However, the cam follower 406 includes six surfaces that must be machined. As shown in FIGS. 20(A)–(D), the six surfaces include the bearing surfaces 406*a*, which are separated by the enlarged portion 406*c*, a cam following surface 406*b*, the thrust surfaces 406*d* of the enlarged portion 406*c*, and a peripheral surface 406*e* of the enlarged portion 406*c*. Each of the surfaces must be ground in different steps using a grindstone that is shaped to correspond to each surface. This complicates and increases the grinding work and lowers productivity.

The valve lifter 404 shown in FIG. 21 must be similarly machined. The valve lifter also has surfaces that must each be ground. The surfaces include the support surfaces of the guide groove 405, which are separated by the slot 405*a*, the thrust surfaces 405*b*, and the bottom surface 405*c* of the slot 405*a*. Five grinding steps are required, which lowers productivity.

SUMMARY OF THE INVENTION

An objective of the present invention is to provide a cam follower mechanism for three-dimensional cams that can be easily ground.

To achieve the above projective, the present invention provides a follower mechanism for transmitting movement of a three-dimensional cam to a valve. The cam has a cam surface for driving the valve. The cam surface has a profile that varies in the axial direction of the cam. The follower mechanism comprise a valve lifter arranged between the cam and the valve to transmit movement of the cam to the valve. A guide groove extends perpendicular to the axis of the cam and provided on the valve lifter. The guide groove is defined by a retainer surface that has an arcuate cross-section. A cam follower is retained in the guide groove to engage the cam surface. The cam follower pivots about a pivot axis and has an arcuate surface that contacts the retainer surface of the guide groove. The arcuate surface includes a tapered outer surface. It is tapered relative to the pivot axis at an angle less than 90 degrees. The retainer surface includes an inner tapered surface corresponding to the outer tapered surface of the follower. Movement of the cam follower is restricted in a direction of the pivot axis by contact between the outer tapered surface and the inner tapered surface.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of the present invention will now be described with reference to FIGS. 1–7.

Figure 1:
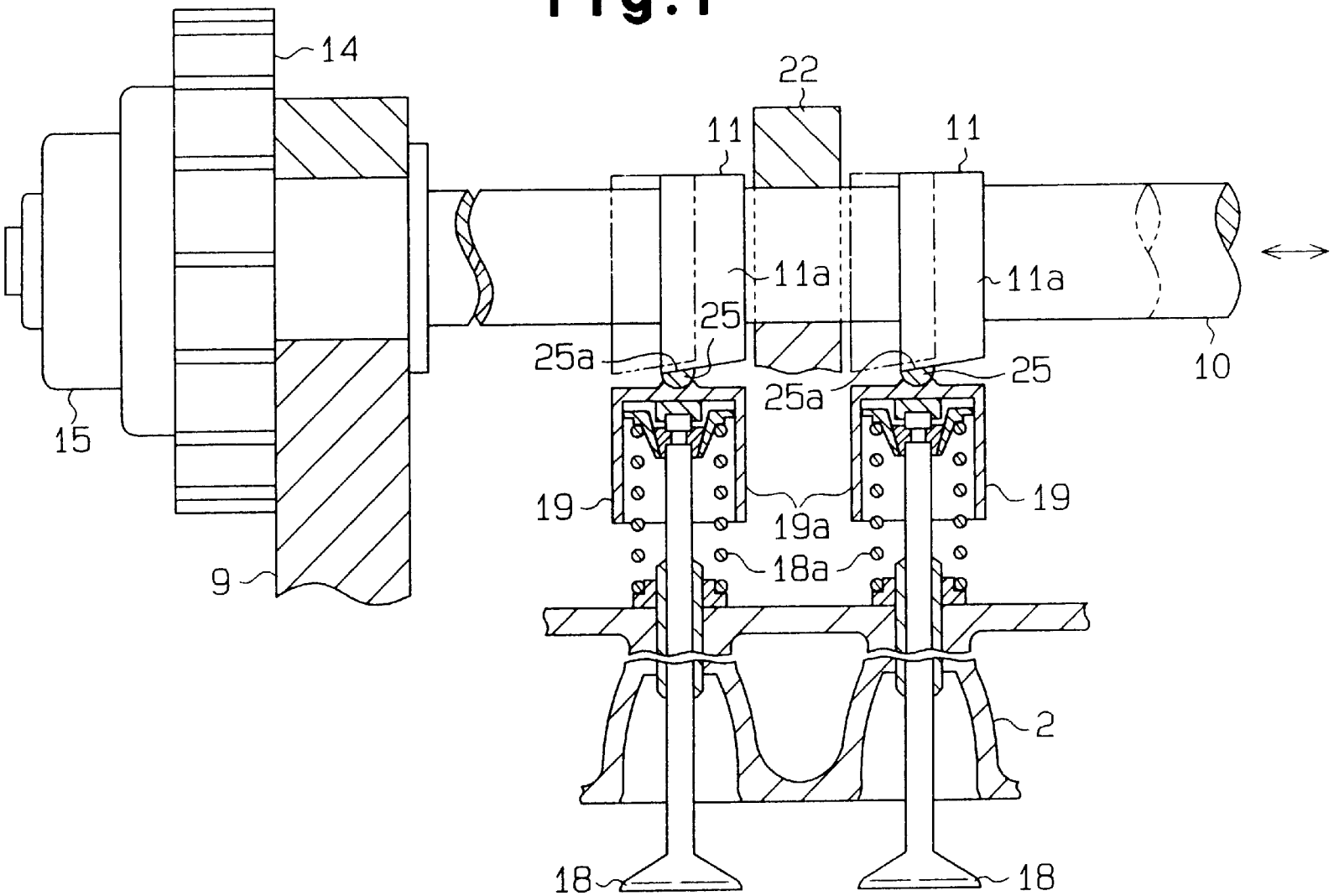
FIG. 1 is a schematic view of a valve drive mechanism according to a first embodiment of the present invention.
Figure 2:
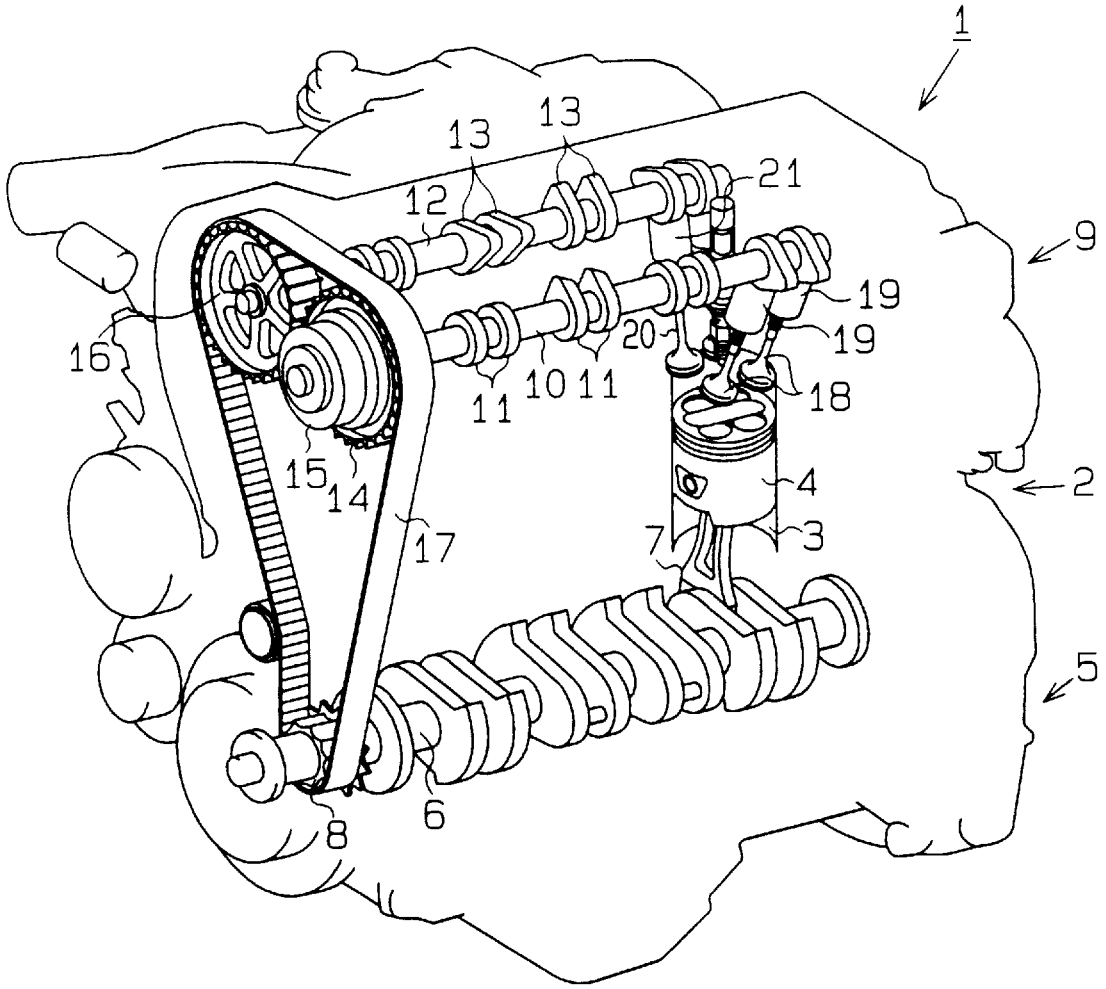
FIG. 2 is a schematic view of a gasoline engine having the mechanism of FIG. 1.

FIG. 1 shows a valve drive mechanism for a cam follower mechanism. FIG. 2 shows a gasoline engine 1 including the valve drive mechanism of FIG. 1. The engine 1 is a DOHC type engine, which has four valves (two intake valves and two exhaust valves) per cylinder.

As shown in FIG. 2, a cylinder block 2 of the engine 1 includes a plurality of cylinders 3 (only one shown). A piston 4 is provided in each cylinder 3. A crankcase 5 supports a crankshaft 6 and is fixed at a lower portion of the cylinder block 2. Each piston 4 is connected to the crankshaft 6 through a corresponding connecting rod 7. A timing pulley 8 is located at one end of the crankshaft 6.

A cylinder head 9 is fixed on an upper portion of the cylinder block 2. An intake camshaft 10 is rotatably supported in the cylinder head 9 through journal bearings 22 (only one shown in FIG. 1). The intake camshaft 10 moves axially. Intake cams 11 are integrally fixed to the intake camshaft 10. Two intake cams 11 are associated with each cylinder 3. Also, an exhaust camshaft 12 is rotatably supported in the cylinder head 9 through journal bearings (not shown). The exhaust camshaft 12 is not permitted to move axially. Exhaust cams 13 are integrally fixed to the exhaust camshaft 12. Two exhaust cams 13 are associated with each cylinder 3.

A timing pulley 14 and a shaft drive mechanism 15 are provided at one end of the intake camshaft 10. A timing pulley 16 is provided at one end of the exhaust camshaft 12. The timing pulleys 14, 16 are connected to the timing pulley 8 of the crankshaft 6 through the timing belt 17. The rotation of the crankshaft 6 rotates the intake camshaft 10 and the exhaust camshaft 12.

Each cylinder 3 includes two intake valves 18. Each intake valve 18 cooperates with the corresponding intake cam 11 through a valve lifter 19. Each valve lifter 19 is supported in a corresponding lifter bore (not shown) in the cylinder head 9 such that the valve lifter does not rotate and can move axially.

Each cylinder 3 also includes two exhaust valves 20. Each exhaust valve 20 cooperates with the corresponding exhaust cam 13 through a valve lifter 21. Each valve lifter 21 is supported in a corresponding lifter bore (not shown) in the cylinder head 9 such that the valve lifter does not rotate and can move axially.

The intake cam 11 is a three-dimensional cam. As shown in FIG. 1, the cam nose of the intake cam 11 is continuously varied in the axial direction. The exhaust cam 13 is a normal cam, the cam nose of which does not vary in the axial direction.

As the intake camshaft 10 rotates, the intake cam 11 selectively opens/closes the intake valve 18 through the corresponding valve lifter 19. As the exhaust camshaft 12 rotates, the exhaust cam 13 selectively opens/closes the exhaust valve 20 through the corresponding valve lifter 21.

Figure 3:
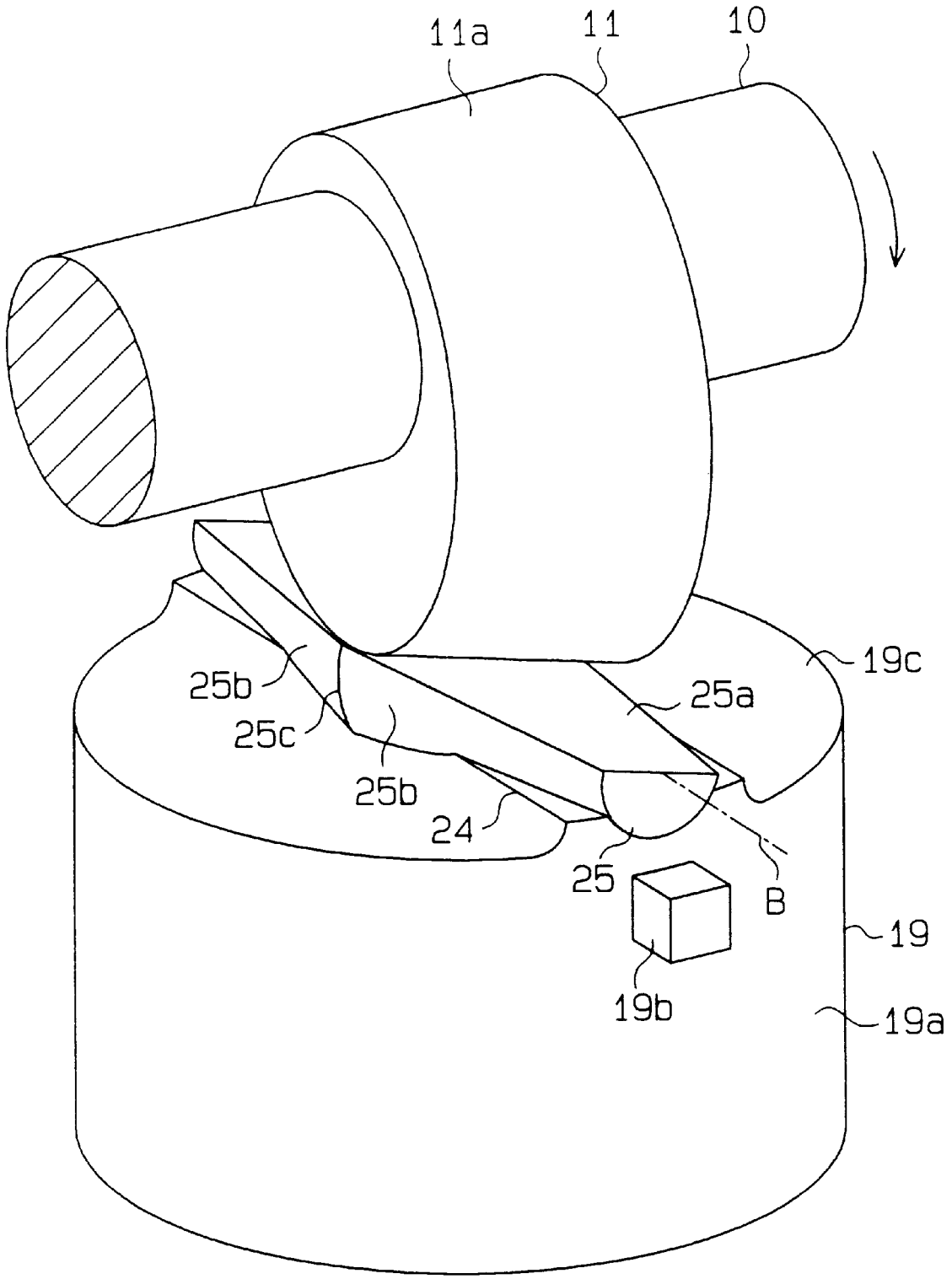
FIG. 3 is a perspective view of a cam follower mechanism formed in the mechanism of FIG. 1.
Figure 4:
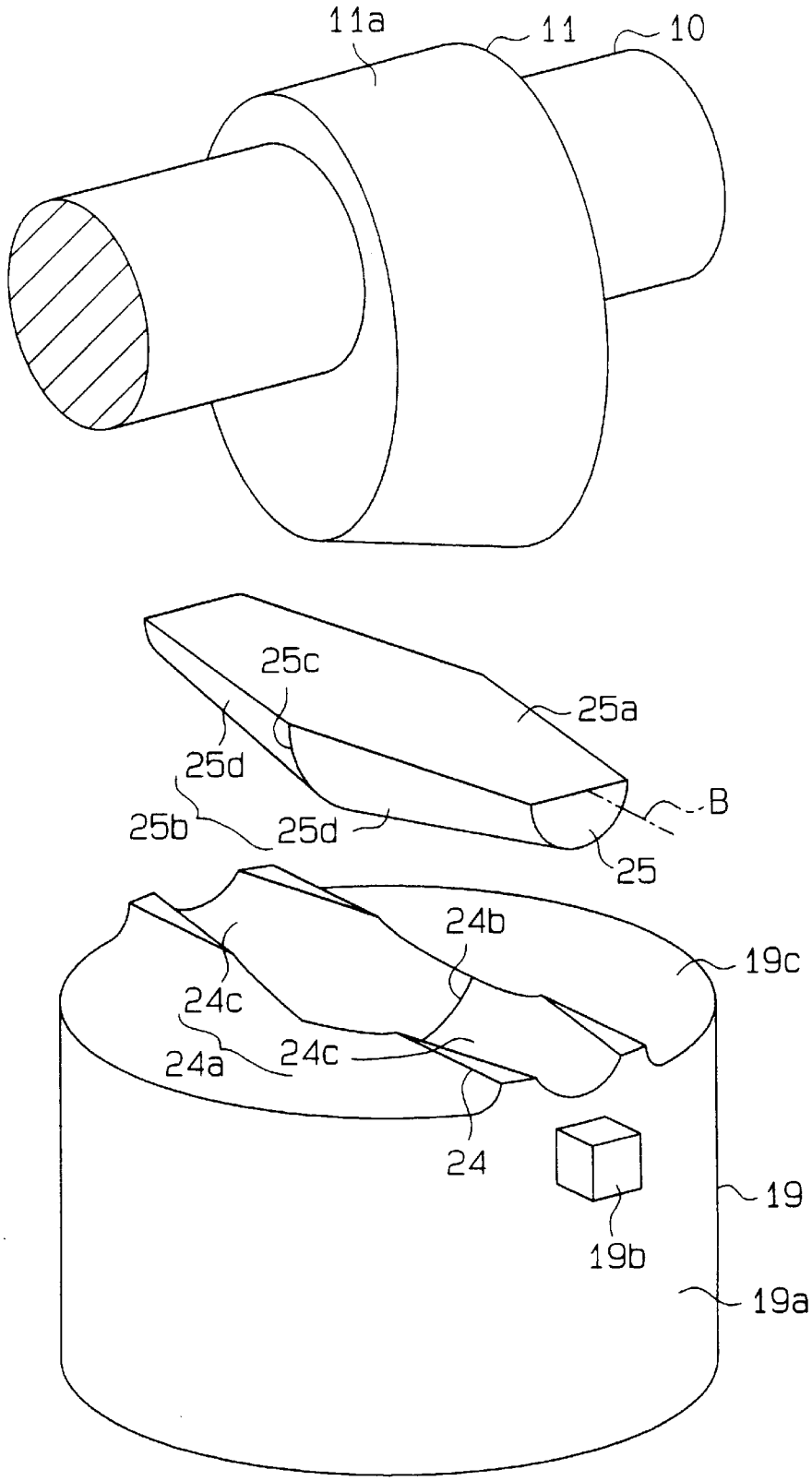
FIG. 4 is an exploded perspective view of the cam follower mechanism of FIG. 3.
Figure 5A:
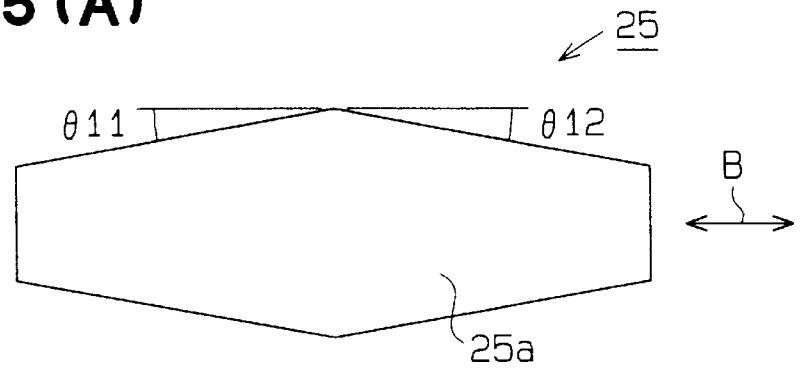
FIG. 5(A) is a top plan view of the cam follower of FIG. 3.
Figure 5B:
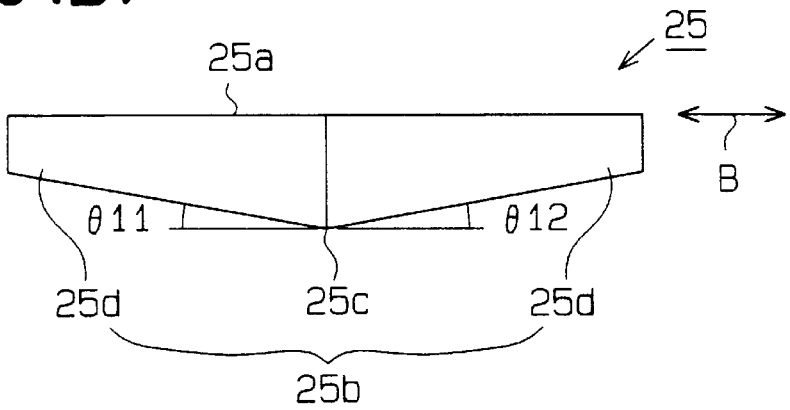
FIG. 5(B) is a front view of the cam follower of FIG. 3.
Figure 5C:
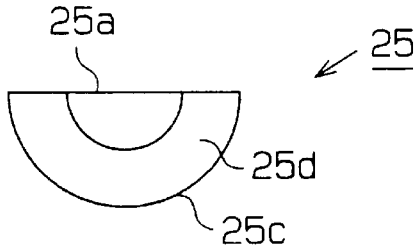
FIG. 5(C) is an end view of the cam follower of FIG. 3.
Figure 5D:
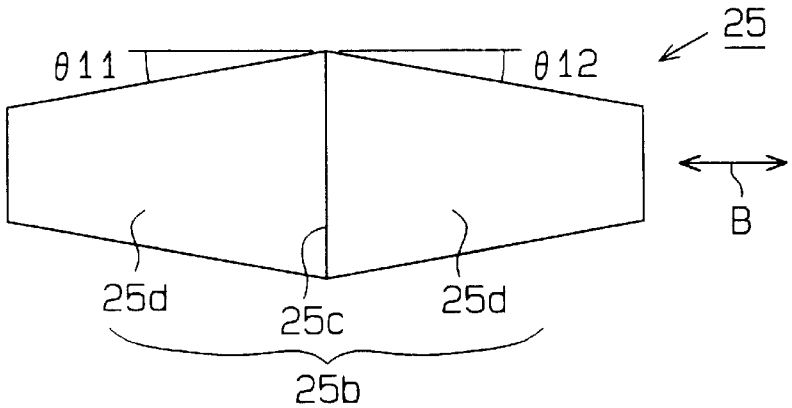
FIG. 5(D) is a bottom plan view of the cam follower of FIG. 3.

As shown in FIGS. 3 and 4, the valve lifter 19 is columnar. A guide 19*b* is provided on the peripheral surface 19*a* of the valve lifter 19. The guide 19*b* is received in a guide groove (not shown), which is formed in the inner surface of the lifter bore. The guide 19*b* prevents rotation of the valve lifter 19 and guides the valve lifter 19 to slide axially in the lifter bore.

A cam follower holder 24 is integrally formed on the upper surface 19*c* of the valve lifter 19. The cam follower holder 24 includes a guide groove 24*a*, which extends in a direction perpendicular to the axis of the intake cam 11. The cross-section of the guide groove 24*a* is arcuate. A cam follower 25 is pivotally supported in the guide groove 24*a*. The cross-section of the cam follower 25 is arcuate. The cam follower 25 includes an arcuate surface 25*b*, which contacts the guide groove 24*a*, and a flat surface 25*a*, which engages the cam surface 11*a* of the intake cam 11.

A spring 18*a* (shown in FIG. 1) is located between each valve lifter 19 and the cylinder head 9 to urge the valve lifters 19 toward the intake cams 11. Therefore, the flat surface 25*a* of the cam follower 25 is pressed against the cam surface 11*a* of the intake cam 11. During rotation of the intake cam 11, the cam follower 25 pivots about an axis B, which extends in the longitudinal direction of the cam follower 25 in accordance with the variation of the angle of the cam surface 11*a*.

The shaft drive mechanism 15 shown in FIG. 1 moves, the intake camshaft 10 in the axial direction in accordance with the operation of the engine 1. As the intake camshaft 10 is moved, the axial location of contact between the flat surface 25*a* of the cam follower 25 and the cam surface 11*a* of the intake cam 11 is varied. As a result, the lift amount of the intake valve 18 is changed, which adjusts the valve timing.

As shown in FIGS. 4 and 5(A)–(D), the cam follower 25 is shaped like a bisection of two truncated cones joined at their bases. The flat surface 25*a* extends along the pivoting axis B of the cam follower 25 and is hexagonal. The arcuate surface 25*b* includes a pair of symmetrical tapered surfaces 25*d,* which become narrower from the middle of the cam follower toward its ends. An arcuate, outer ridgeline 25*c* is formed at the middle of the cam follower 25, or at the intersection of the tapered surfaces 25*d.* The radius of the arcuate surface 25*b* is greatest at the outer ridgeline 25*c.*

Figure 6:
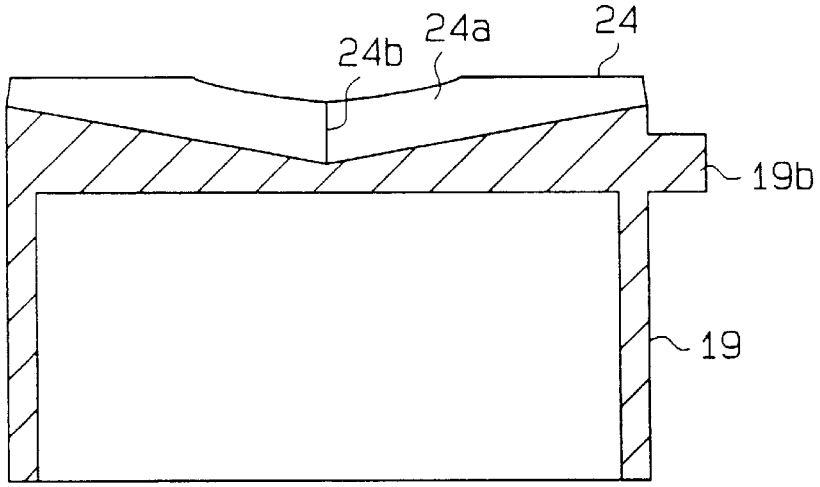
FIG. 6 is a cross sectional view of the valve lifter of FIG. 3.

As shown in FIG. 6, the shape of the guide groove 24*a* corresponds to the shape of the arcuate surface 25*b.* The guide groove 24*a* includes a pair of retainer surfaces 24*c,* which correspond to the pair of tapered surfaces 25*d* of the arcuate surface 25*b.* An inner ridgeline 24*b* is formed at the middle of the guide groove 24*a.* The inner ridgeline 24*b* is located at the intersection of the retainer surfaces 24*c.*

As shown in FIG. 3, when the cam follower 25 is fitted in the guide groove 24*a,* the outer ridgeline 25*c* engages the inner ridgeline 24*b.* This prevents the cam follower 25 from moving axially.

The present embodiment has the following advantages.

Figure 19:
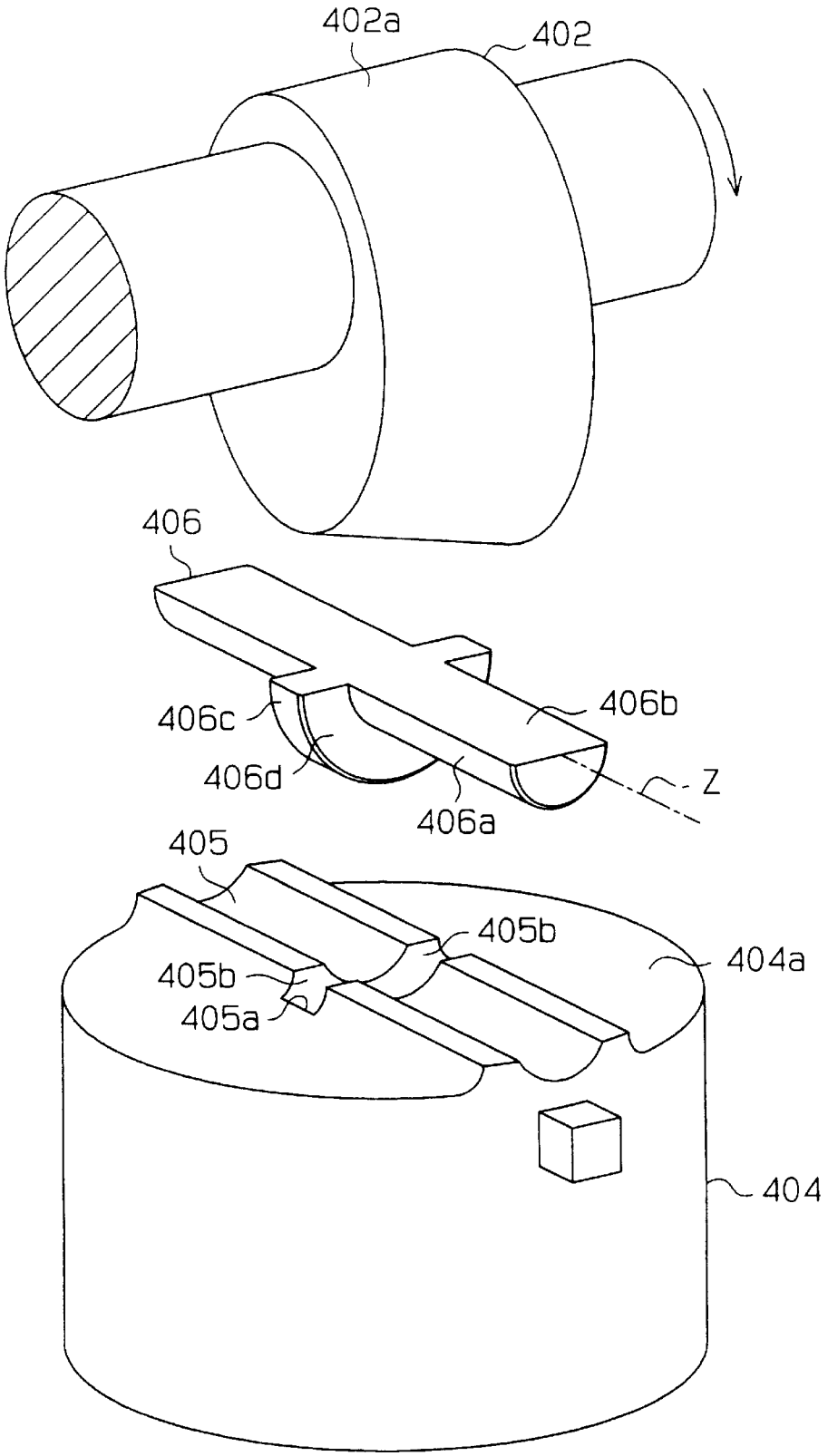
Fig.19 (Prior Art)
FIG. 19 is an exploded perspective view of the cam follower mechanism of FIG. 18.
Figure 20A:
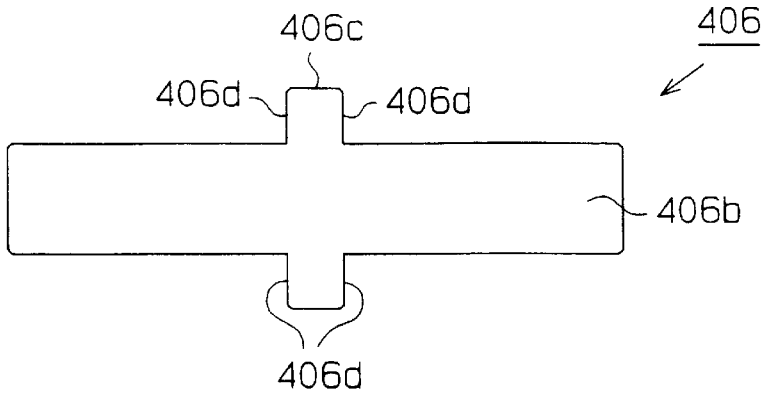
Fig.20(A) (Prior Art)
FIG. 20(A) is a top plan view of the cam follower of FIG. 18.
Figure 20B:
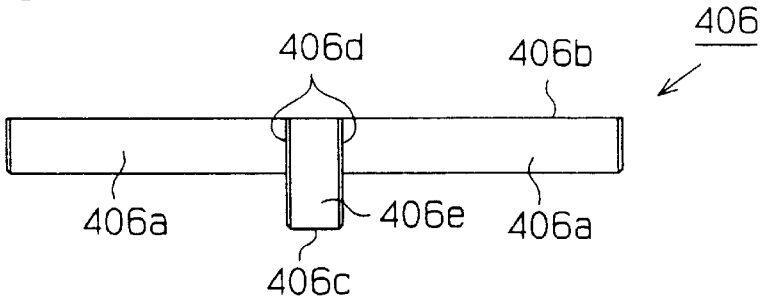
Fig.20(B) (Prior Art)
FIG. 20(B) is a front view of the cam follower of FIG. 18.
Figure 20C:
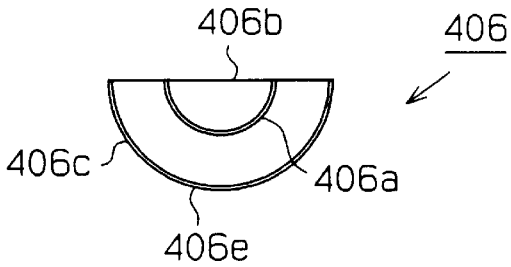
Fig.20(C) (Prior Art)
FIG. 20(C) is an end view of the cam follower of FIG. 18.
Figure 20D:
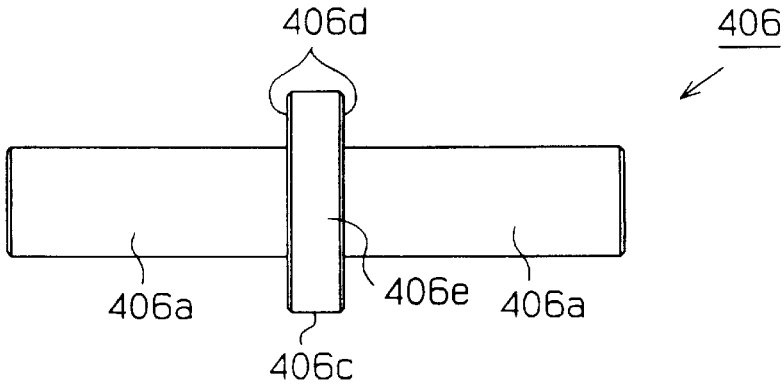
Fig.20(D) (Prior Art)
FIG. 20(D) is a bottom view of the cam follower of FIG. 18.
Figure 21:
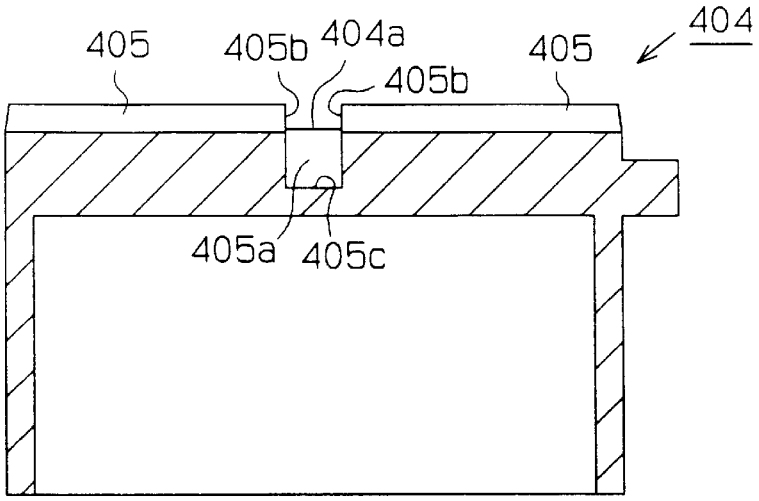
Fig.21 (Prior Art)
FIG. 21 is a cross sectional view of the valve lifter of FIG. 18.

The cam follower 25 has three surfaces to be ground, that is, the flat surface 25*a* and tapered surfaces 25*d,* which are separated by the outer ridgeline 25*c.* Therefore, the grinding of the follower can be performed in; that is, a step for grinding the flat surface 25*a* and two steps for grinding the tapered surfaces 25*d.* Accordingly, the number of grinding steps can be halved compared to the prior art cam follower of FIG. 19.

Also, the guide groove 24*a* has only two surfaces to be ground, which are the retainer surfaces 24*c.* Thus, the retainer surfaces 24*c* can be ground in two steps at most. Accordingly, fewer grinding steps are required compared to the prior art guide groove of FIG. 19. This improves productivity and efficiency.

As shown in FIGS. 5(A)–(D), angles θ11, θ12, which are formed between the arcuate surface 25*b* and the pivoting axis B, are chosen to be less than ninety degrees (for example, 10–35 degrees). In other words, the cam follower 25 does not have a load bearing perpendicular to the pivoting axis B. That is, the arcuate surface 25*b* can be ground by a single grindstone applied perpendicularly to the pivoting axis B. In other words, the two tapered surfaces 25*d* can be ground simultaneously by one grindstone. Accordingly, a minimum of only one grinding step is required for the arcuate surface 25*b,* and a minimum total of two steps are required for grinding the cam follower 25.

The angle formed between the retainer surfaces 24*c* and the pivoting axis B is smaller than ninety degrees (the same as θ11, θ12). Therefore, a minimum of only one grinding step is required for grinding the retainer surfaces 24*c.*

Figure 22:
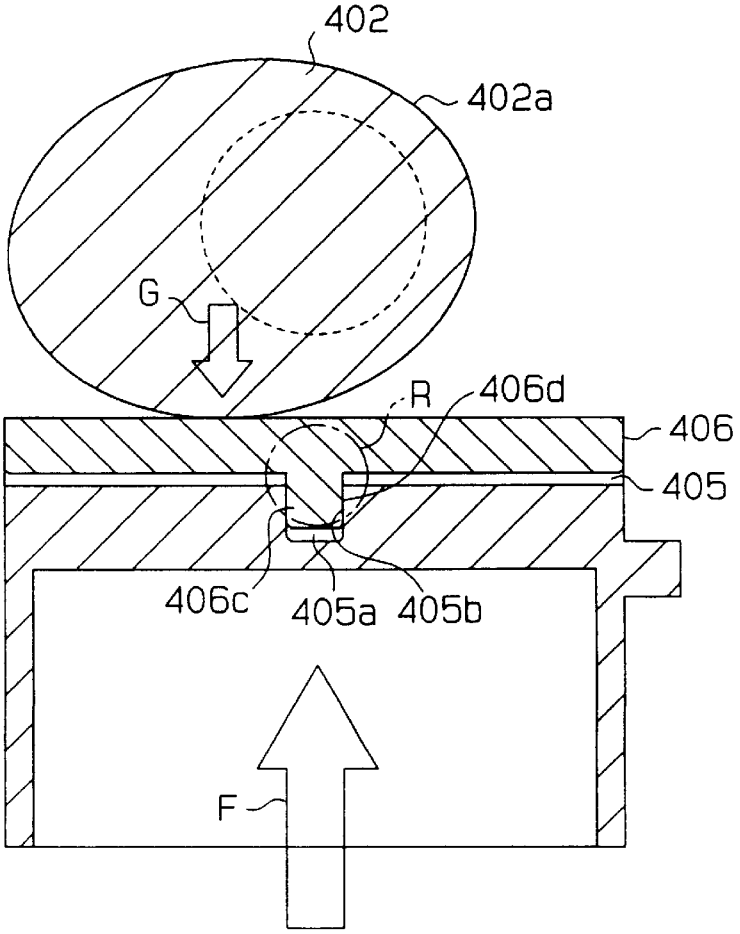
Fig.22 (Prior Art)
FIG. 22 is a cross sectional view illustrating the cam follower mechanism of FIG. 18.

The enlarged portion 406*c* and the slot 405*a* of the prior art device (FIGS. 18–21) include surfaces perpendicular to the pivoting axis Z of the cam follower 406, that is, the thrust surfaces 406*d,* 405*b.* Therefore, as shown in FIG. 22, when the cam follower 406 is separated from the guide groove 405 by a shock, the thrust surface 406*d* stays in contact with the thrust surface 405*b.* In this state, when a shock G is applied to a location offset from the enlarged portion 406*c,* the shock G causes the cam follower 406 to incline. This damages the corners of the enlarged portion 406*c* and causes the rim of the slot 405*a* to damage the thrust surfaces 405*b,* 406*d.* Also, a great bending force is applied to the enlarged portion 406*c,* which may cause a proximal portion R of the enlarged portion 406*c* to crack.

Figure 7:
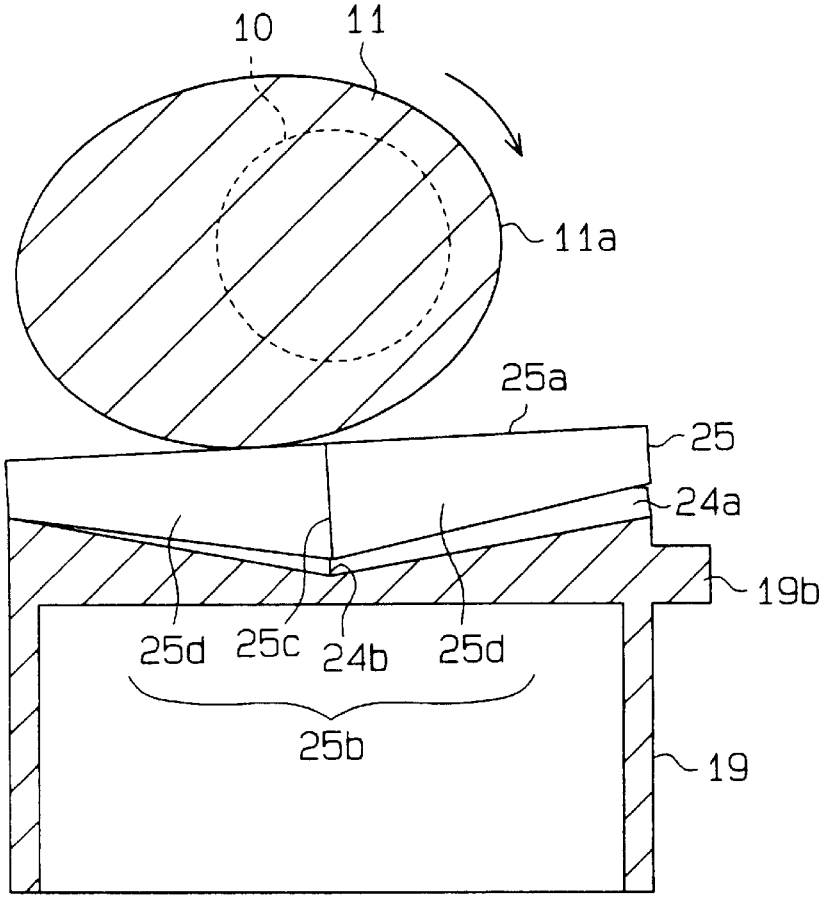
FIG. 7 is a cross sectional view illustrating operation of the cam follower mechanism of FIG. 3.
Figure 8:
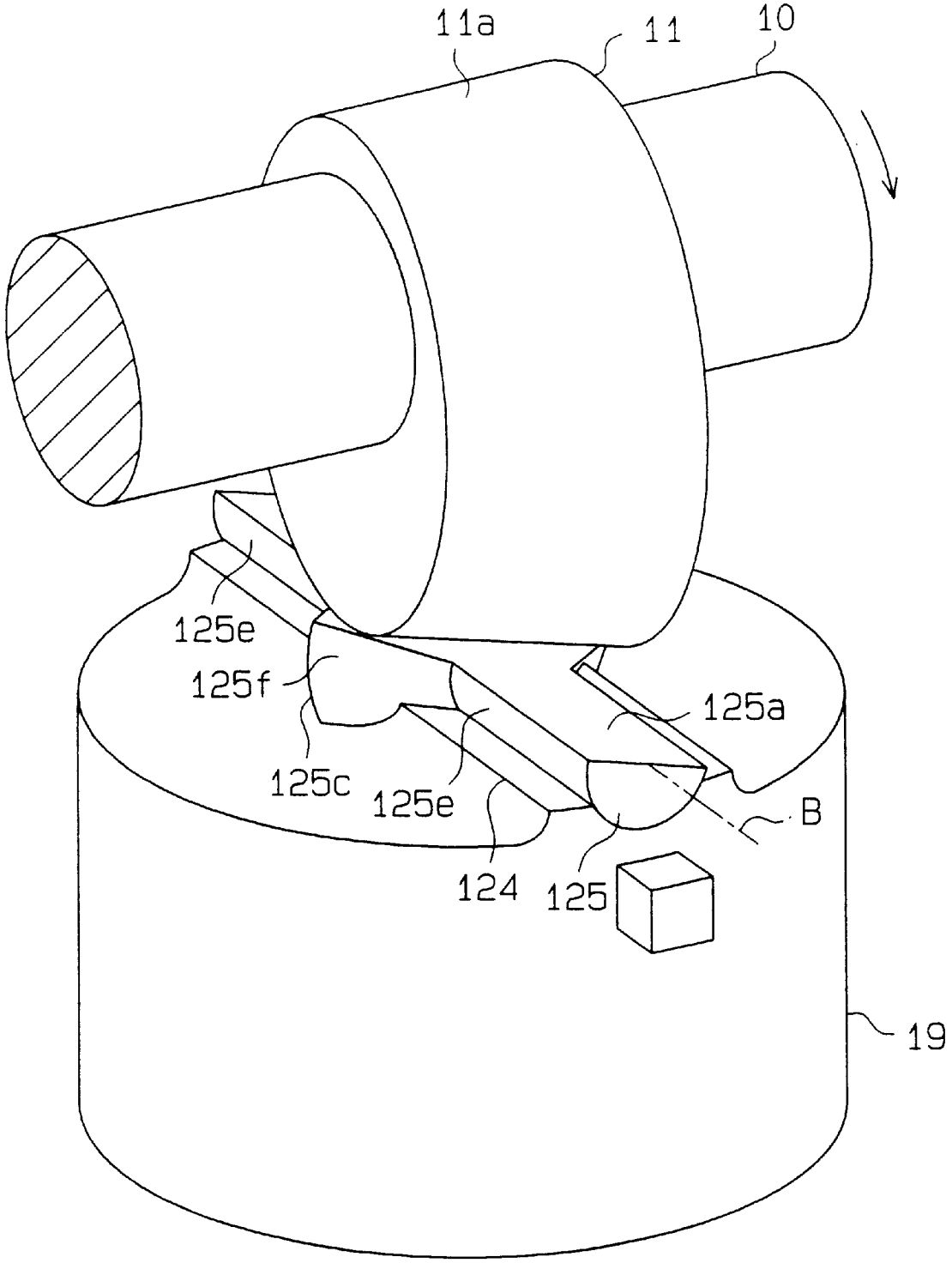
FIG. 8 is a perspective view of a cam follower mechanism according to a second embodiment of the present invention.
Figure 9:
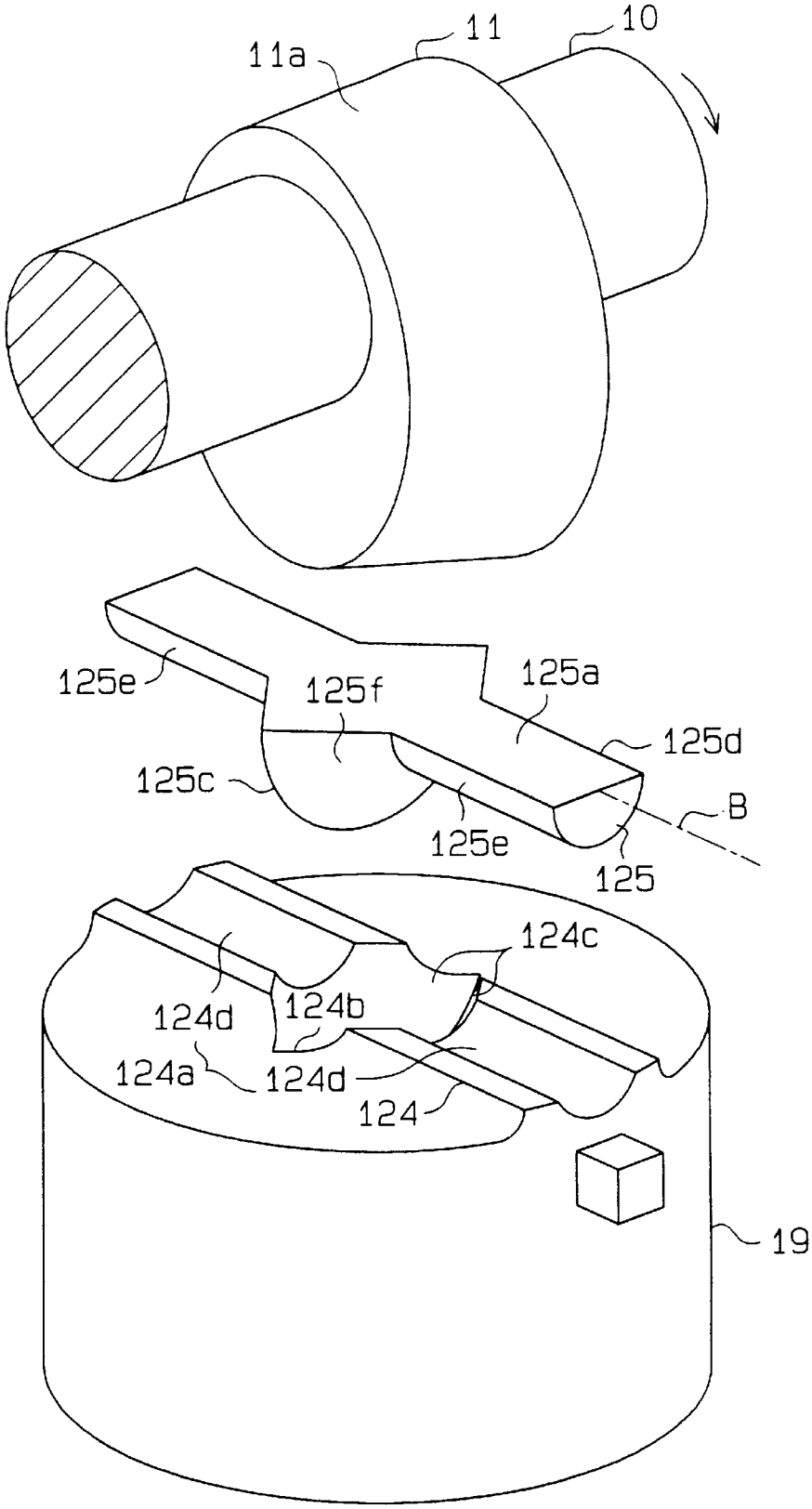
FIG. 9 is an exploded perspective view of the cam follower mechanism of FIG. 8.
Figure 10A:
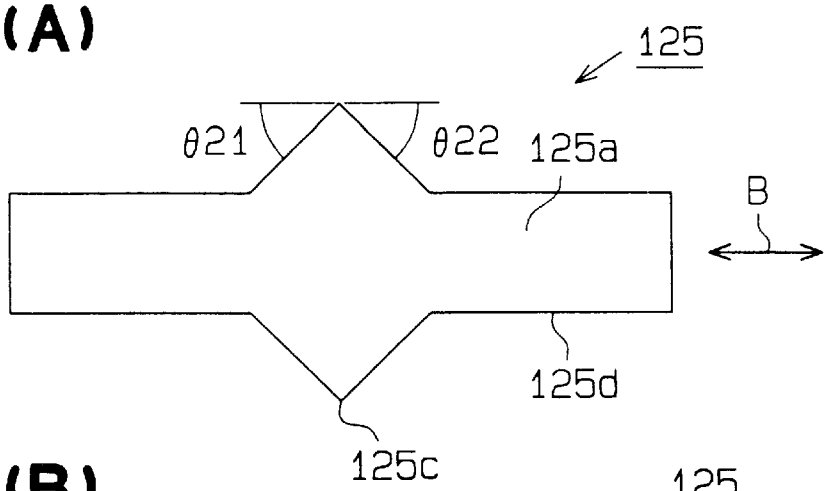
FIG. 10(A) is a top plan view of the cam follower of FIG. 8.
Figure 10B:
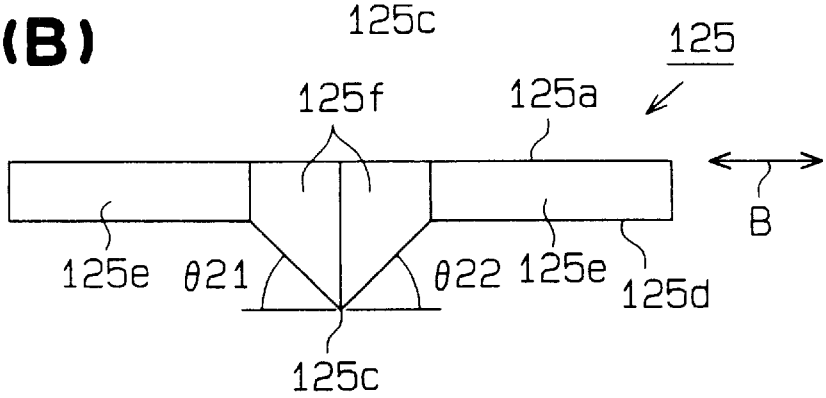
FIG. 10(B) is a front view of the cam follower of FIG. 8.
Figure 10C:
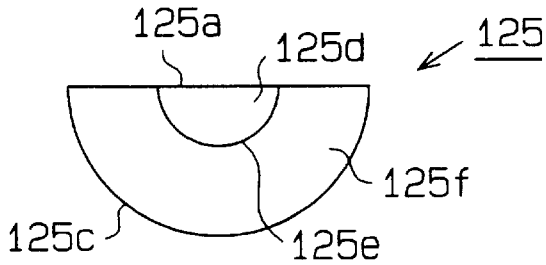
FIG. 10(C) is a end view of the cam follower of FIG. 8.
Figure 10D:
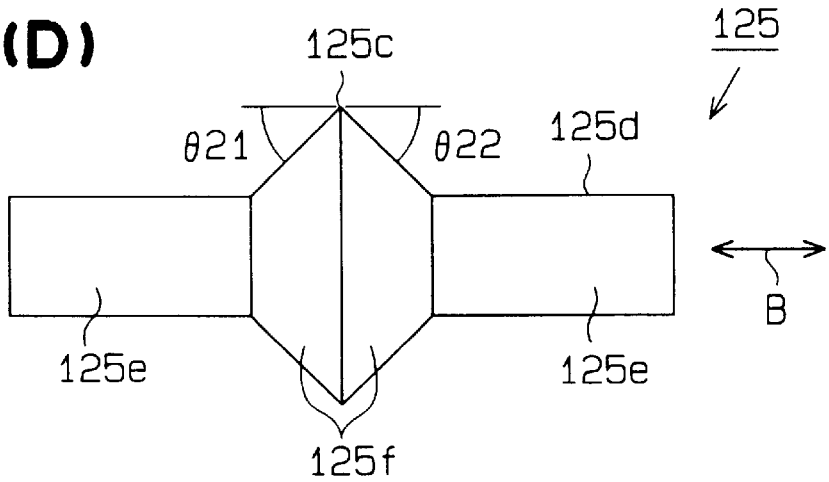
FIG. 10(D) is a bottom plan view of the cam follower of FIG. 8.
Figure 11:
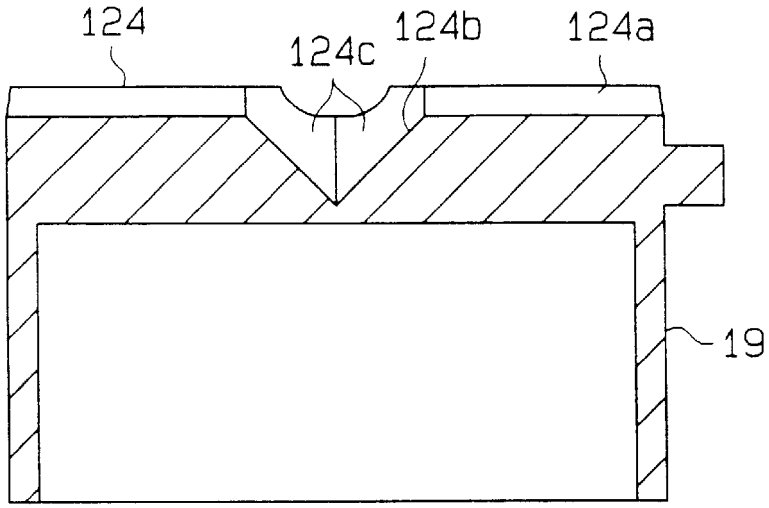
FIG. 11 is a cross sectional view of the valve lifter of FIG. 8.

In contrast, the cam follower 25 of the present invention does not have a surface perpendicular to the pivoting axis B. Therefore, as shown in FIG. 7, when a shock from the intake cam 11 is applied to the cam follower 25 while the cam follower 25 is separated from the guide groove 24*a* by a shock, the cam follower can incline. The outer ridgeline 25*c* does not damage the guide groove 24*a,* and no bending force is generated. This makes the cam follower mechanism more durable.

FIGS. 8–12 show a cam follower mechanism according to a second embodiment of the present invention. The structures of the cam follower 125 and the cam follower holder 124 are different from those of the embodiment shown FIGS. 1–7.

As shown in FIGS. 9 and 10(A)–(D), the cam follower 125 includes a pair of semi-columnar bodies 125*d* and an enlarged portion 125*c.* The enlarged portion 125*c* is located at the axial center of the cam follower 125 and has a greater radius than other parts of the cam follower 125. The cam follower 125 includes a flat surface 125*a,* which contacts the cam 11. The follower 125 includes a pair of semi-cylindrical surfaces 125*e,* which are separated by the enlarged portion 125*c.* The enlarged portion 125*c* includes two tapered surfaces 125*f.*

A cam follower holder 124 is formed on the upper surface of the valve lifter 19. A guide groove 124*a* is formed in the cam follower holder 124 and has a shape corresponding to the cam follower 125. The guide groove 124*a* includes two retainer surfaces 124*d,* which are separated by a tapered cavity 124*b.* The cavity 124*b* is formed in the axial center of the guide groove 124*a.* The shape of the cavity 124*b* corresponds to that of the enlarged portion 125*c* of the cam follower 125 and is defined by a pair of tapered surfaces 124*c.*

When the cam follower 125 is fitted in the guide groove 124*a,* the semi-cylindrical surfaces 125*e* of the cam follower 125 contact the retainer surfaces 124*d* of the guide groove 124*a.* Further, the tapered surfaces 125*f* contact the tapered surfaces 124*c* of the cavity 124*b.* This prevents the cam follower 125 from moving axially during the rotation of the cam 11. That is, the cam follower 125 pivots about the pivoting axis B, but its movement in the direction of the axis B is limited.

The present invention has the following advantages.

The cam follower 125 includes five surfaces to be ground; that is, the two semi-cylindrical surfaces 125*e,* the two tapered surfaces 125*f,* and the flat surface 125*a.* Therefore, there are five grinding steps, at most. Accordingly, the number of grinding steps is reduced compared to the prior art cam follower shown in FIG. 19, which increases efficiency.

Also, in the cam follower holder 124, there are four surfaces to be ground; that is, the two retainer surfaces 124*d* and the two tapered surfaces 124*c.* Therefore, there are four steps for grinding, at most. Accordingly, the number of steps for grinding is reduced compared to the prior art guide groove shown in FIG. 19.

As shown in FIGS. 10(A)–(D), the semi-cylindrical surfaces 125*e* are parallel to the pivoting axis B of the cam follower 125. Angles θ21, θ22, which are formed between the tapered surfaces 125*f* and the pivoting axis B, are chosen to be smaller than ninety degrees (for example, 10 to 70 degrees).

Therefore, none of the semi-cylindrical surfaces 125*e* or the tapered surfaces 125*f* are perpendicular to the pivoting axis B. In other words, as in the embodiment shown in FIGS. 1–7, the semi-cylindrical surfaces 125*e* and the tapered surfaces 125*f* can be ground by applying a grindstone in a direction perpendicular to the pivoting axis B. Thus, it is possible to grind the semi-cylindrical surfaces 125*e* and the tapered surfaces in one step using one grindstone. This reduces the number of grinding steps and simplifies the grinding process.

Also, in the cam follower holder 124, the angles formed by the tapered surfaces 124*c* and the pivoting axis B are smaller than ninety degrees (the same as θ21, θ22). Therefore, as in the cam follower 125, the cam follower holder 124 can be ground in one step, which simplifies the grinding process.

Figure 12:
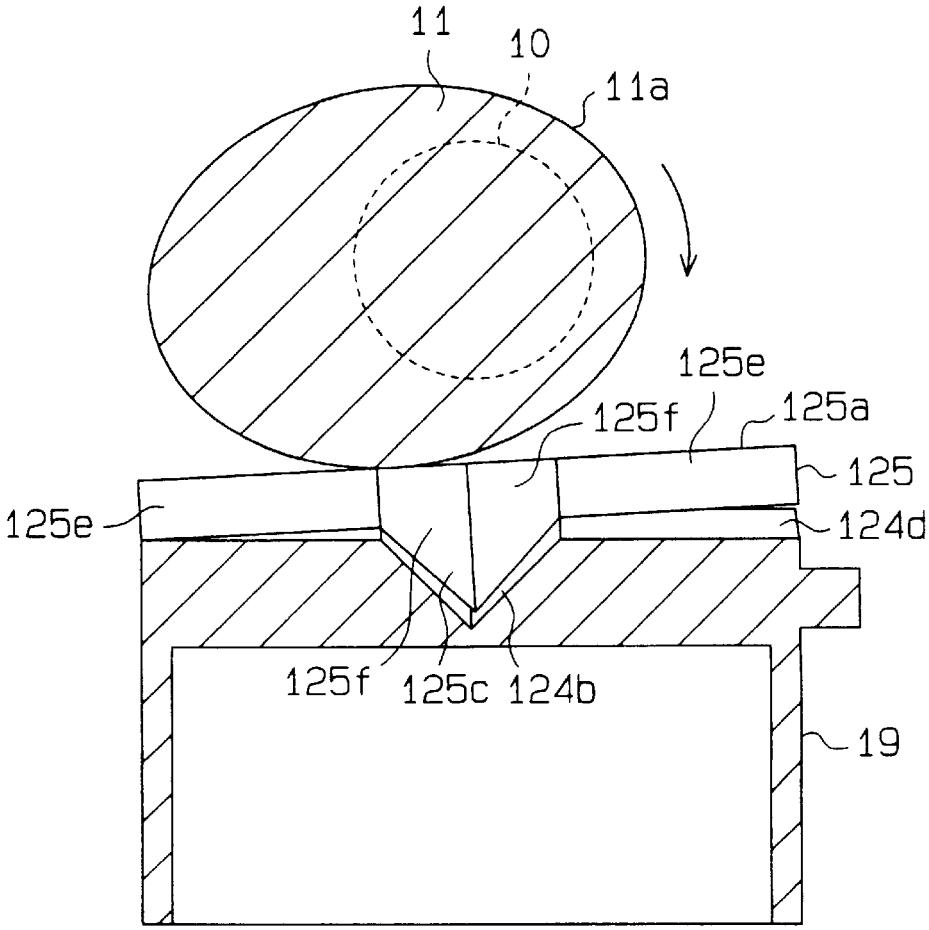
FIG. 12 is a cross sectional view illustrating the operation of the cam follower mechanism of FIG. 8.
Figure 13:
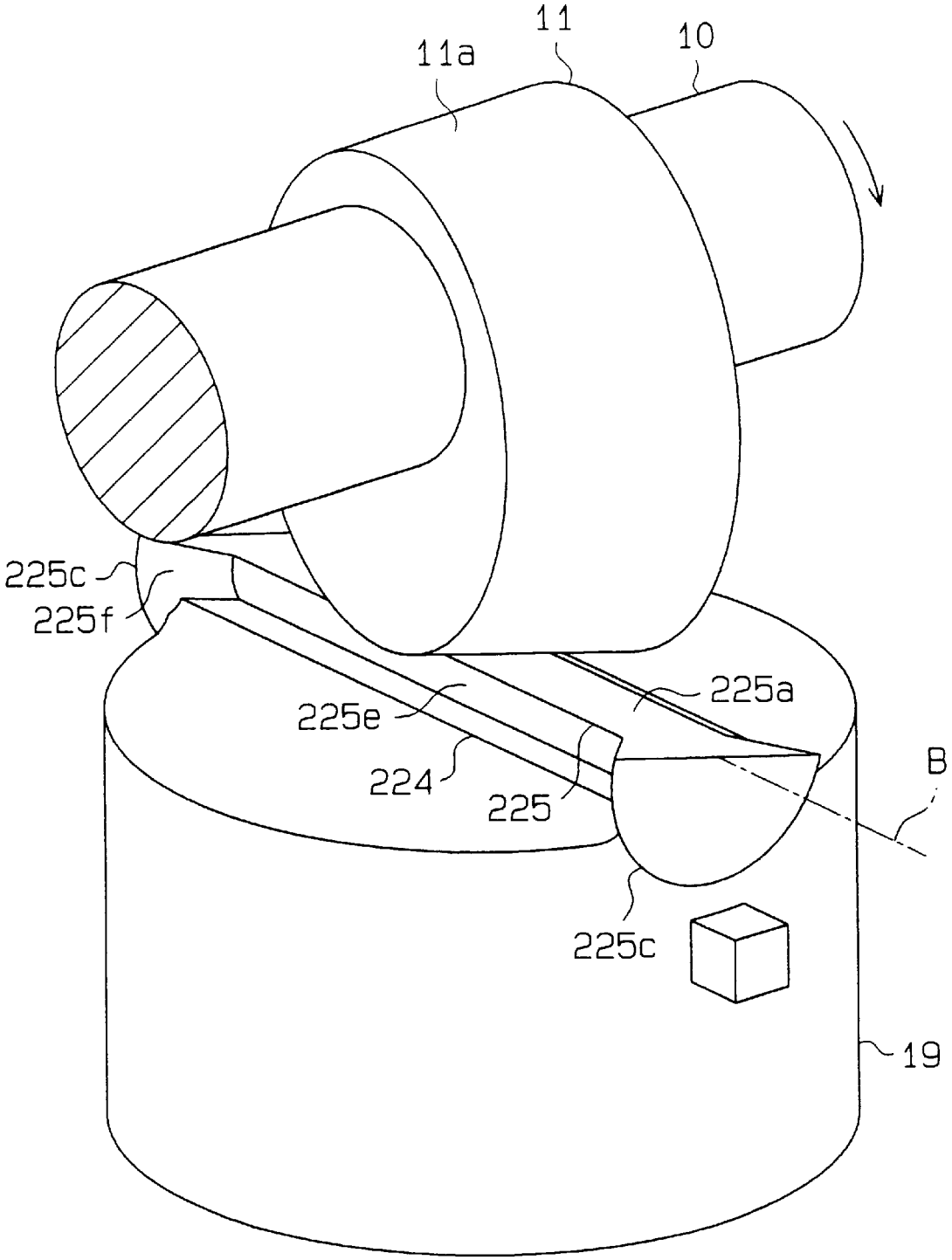
FIG. 13 is a perspective view of a cam follower mechanism according to a third embodiment.

As shown in FIG. 12, when the semi-cylindrical surfaces 125*e* and the tapered surfaces 125*f* are separated from the guide groove 124*a* and the cavity 124*b*, a space exists between the enlarged portion 125*c* and the cavity 124*b*. Therefore, when a shock is applied from the intake cam 11 to the flat surface 125*a*, the cam follower 125 is capable of pivoting. The enlarged portion 125*c* does not damage the guide groove 124*a* and bending force is not generated. Therefore, the cam follower mechanism is vary durable.

A third embodiment of the present invention will now be described with reference to FIGS. 13–17, concentrating on the differences from the embodiment shown in FIGS. 1–7.

As shown in FIGS. 14 and 15(A)–(D), the cam follower 225 includes a semi-columnar body 225*d* and two enlarged portions 225*c*, which are located at the ends of the body 225*d*. The upper surface of the cam follower 225 is a flat surface 225*a*, which contacts the cam 11. The body 225*c* includes a semi-cylindrical surface 225*e*. Each enlarged portion 225*c* is shaped like a bisection of a truncated cone and includes a tapered surface 225*f*. The radius of each tapered surface 225*f* increases toward the corresponding end of the follower 225.

Figure 14:
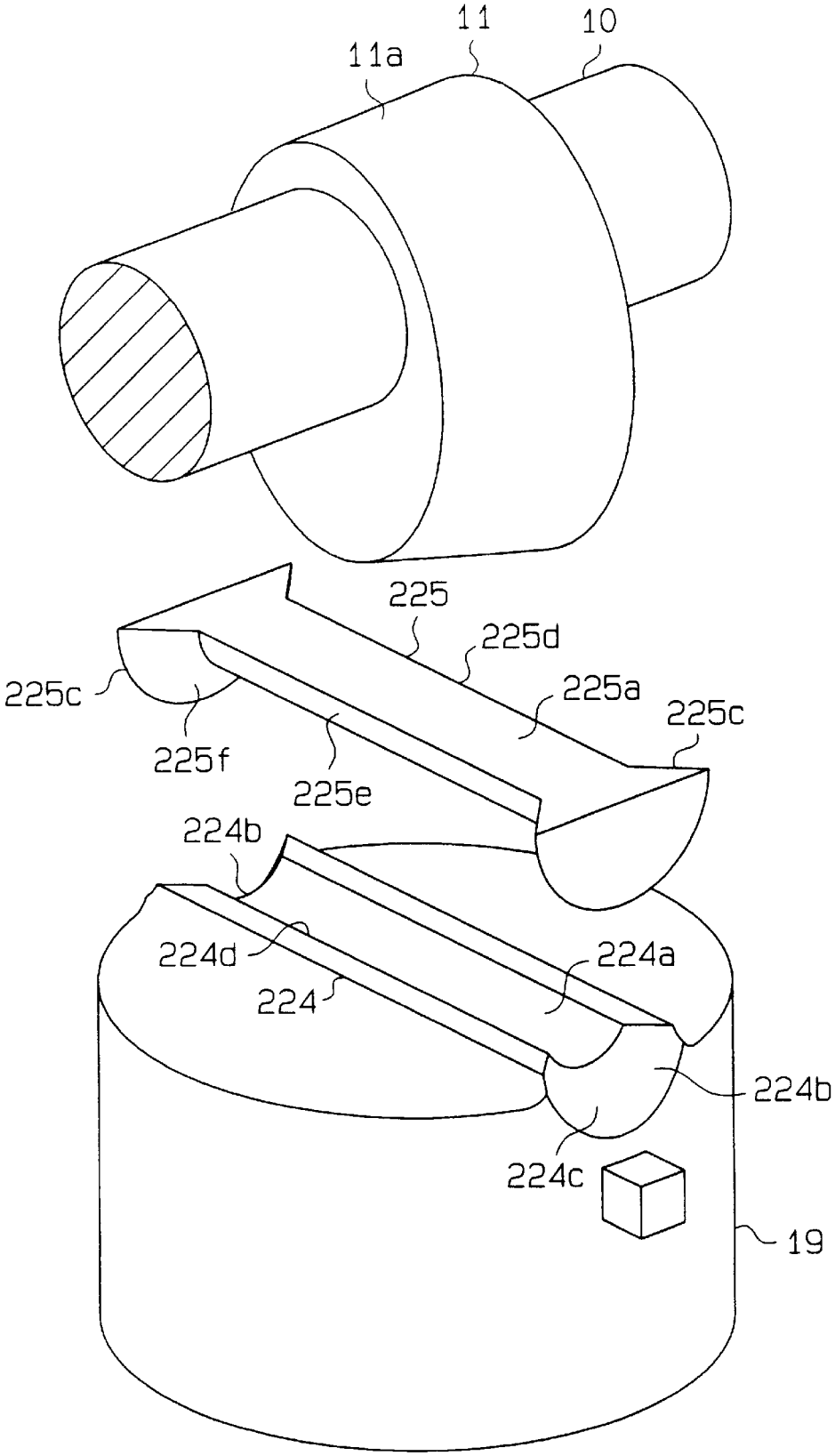
FIG. 14 is an exploded perspective view of the cam follower mechanism of FIG. 13.
Figure 16:
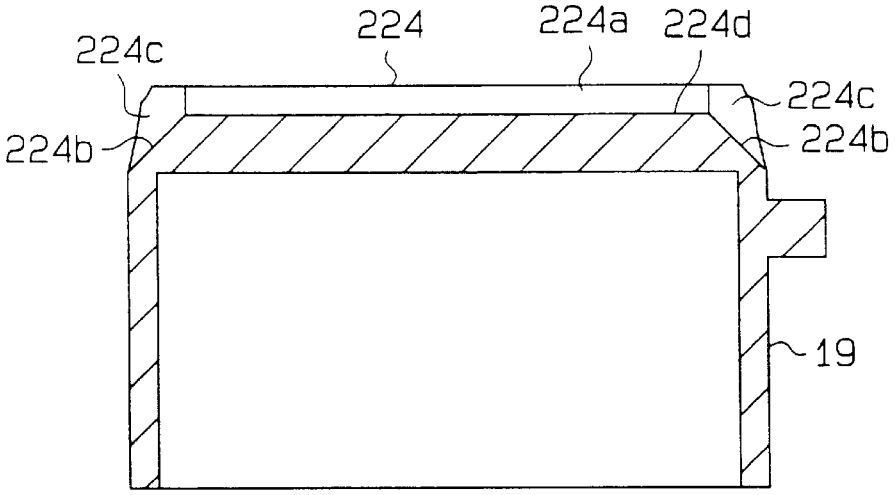
FIG. 16 is a cross sectional view of the valve lifter of FIG. 13.

The cam follower holder 224 includes a guide groove 224*a*. As shown in FIGS. 14 and 16, the guide groove 224*a* includes a retainer surface 224*d* and a pair of inner tapered surfaces 224*b*. The retainer surface 224*d* receives the semi-cylindrical surface 225*e* of the cam follower 225. The inner tapered surfaces 224*b* receive the corresponding tapered surfaces 225*f*.

When the cam follower 225 is located in the guide groove 224*a*, the semi-cylindrical surface 225*e* of the cam follower 225 contacts the semi-cylindrical retainer surface 224*d* of the guide groove 224*b*. The tapered surfaces 225*f* of the enlarged portions 225*c* contact the corresponding inner tapered surfaces 224*b* of the guide groove 224*b*. This prevents the cam follower 225 from moving in the direction of the pivoting axis B while permitting the cam follower 225 to pivot about the pivoting axis B.

The third embodiment has the following advantages.

The cam follower 225 includes four surfaces to be ground; that is, the semi-cylindrical surface 225*e*, the tapered surfaces 225*f* and the flat surface 225*a*. Therefore, at most, there are four grinding steps. The prior art cam follower shown in FIG. 18 requires more than four grinding steps.

Also, in the cam follower holder 224, only the guide groove 224*a* and the inclined surfaces 224*c* need to be ground, which requires three grinding steps at most. Accordingly, the number of grinding steps is reduced compared to the prior art cam follower shown in FIG. 18.

Figure 15A:
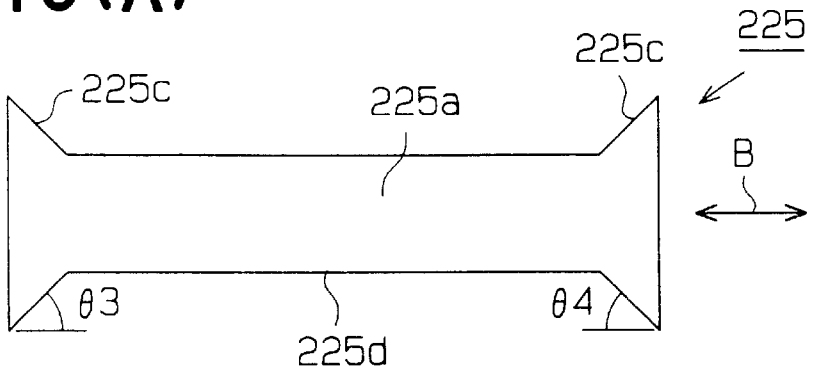
FIG. 15(A) is a top plan view of the cam follower of FIG. 13.
Figure 15B:
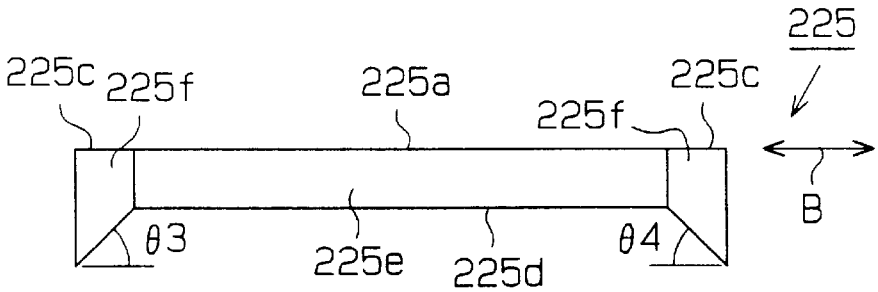
FIG. 15(B) is a front view of the cam follower of FIG. 13.
Figure 15C:
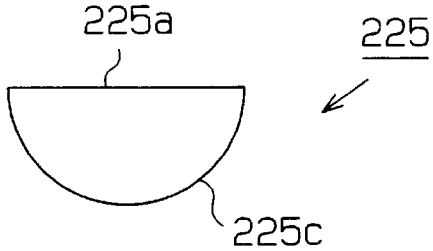
FIG. 15(C) is an end view of the cam follower of FIG. 13.
Figure 15D:
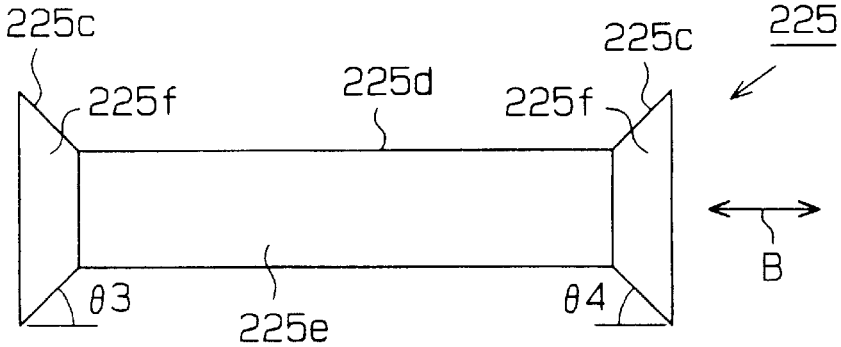
FIG. 15(D) is a bottom plan view of the cam follower of FIG. 13.

As shown in FIGS. 15(A), (B), (D), angles θ3, θ4, which are formed by the tapered surfaces 225*f* and the pivoting axis B of the cam follower 225, are chosen to be smaller than ninety degrees (for example, 10–70 degrees).

Therefore, as in the first embodiment shown in FIGS. 1–7, the semi-cylindrical surface 225*e* and the tapered surfaces 225*f* can be ground simultaneously by one grindstone applied in a direction perpendicular to the pivoting axis B of the cam follower 225. This simplifies the grinding steps for the cam follower 225.

The retainer surface 224*d* and the inner inclined surfaces 224*b* of the cam follower holder 224 are formed to correspond to the shape of the cam follower 225. Therefore, as with the cam follower 225, the steps for grinding the cam follower holder 224 are reduced and simplified.

Figure 17:
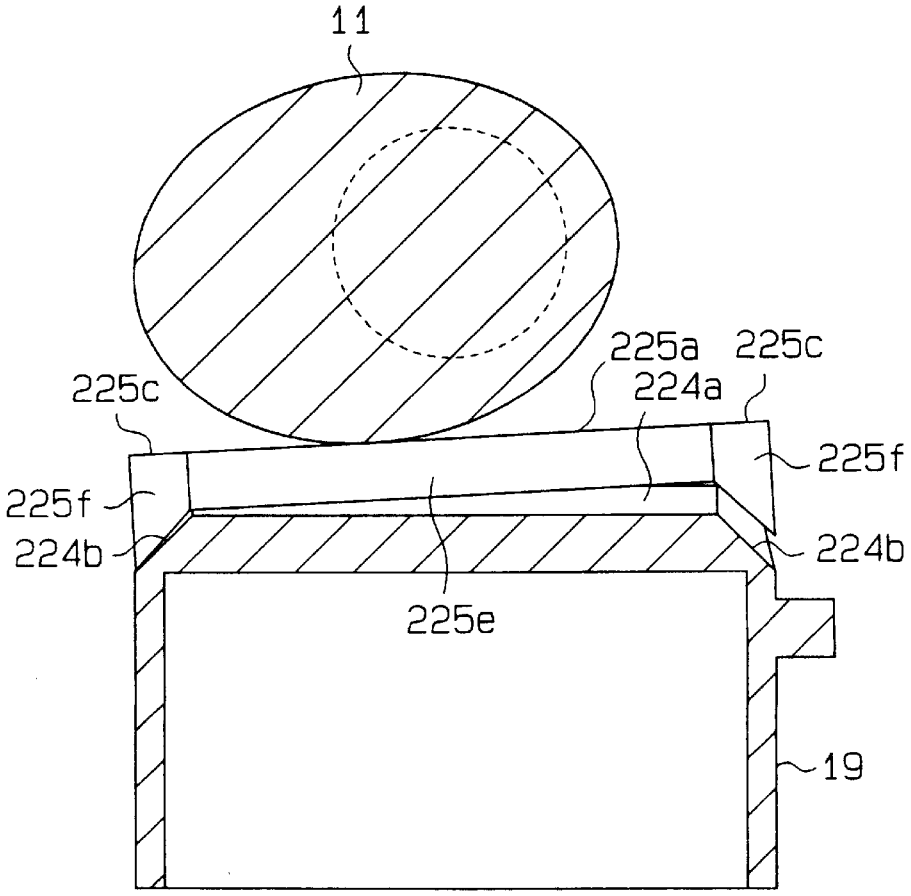
FIG. 17 is a cross sectional view illustrating the operation of the cam follower mechanism of FIG. 13.
Figure 18:
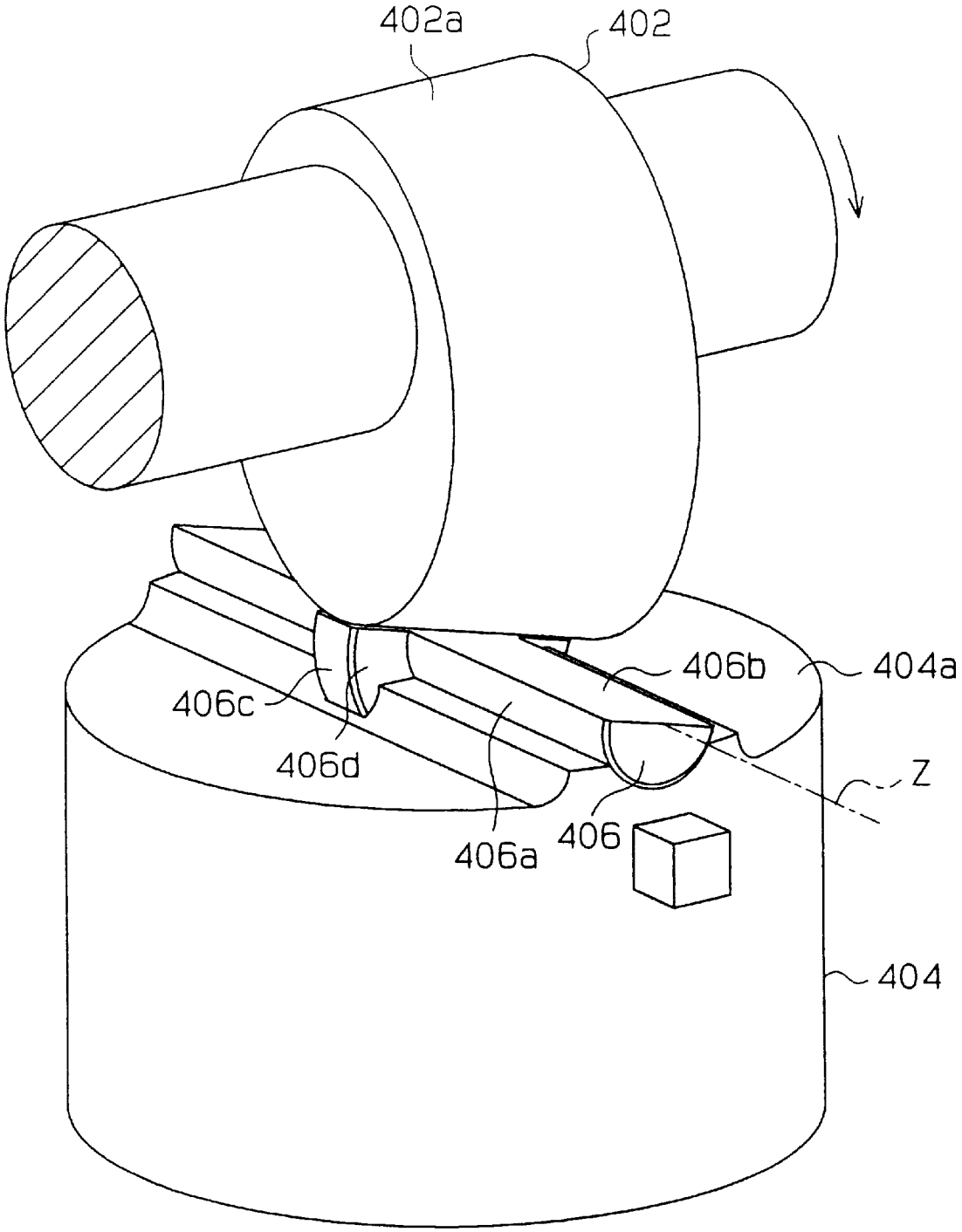
Fig.18 (Prior Art)
FIG. 18 is a perspective view of a prior art cam follower mechanism.

The semi-cylindrical surface 225*e* and the tapered surfaces 225*f* of the cam follower 225 are not perpendicular to the pivoting axis B. Accordingly, as shown in FIG. 17, when the tapered surfaces 225*f* are separated from the guide groove 224*a* and the inner tapered surfaces 224*b*, a space exists between the enlarged portion 225*c* and the inner tapered surfaces 224*b*. Therefore, when a shock is applied from the intake cam 11 to the flat surface 225*a*, the cam follower 225 is capable of pivoting. Also, the enlarged portion 225*c* does not damage the guide groove 224*a* and bending stress is not generated.

The above embodiments can be varied as follows.

In the illustrated cam followers, any corner between two adjoining surfaces may be chamfered.

In the cam followers 25, 125, 225 of the first to the third embodiments, the slide surface 25*b*, the tapered surface 125*f* may be curved in the longitudinal direction of the cam followers. The enlarged portion of FIGS. 10(A), (B), (D) may be hemispherical.

The cam follower 25 of FIG. 5 may be shaped as if top surfaces of two semi truncated cone are put together.

The exhaust cam 13 may be a three-dimensional cam. One of the cam followers shown in FIGS. 1–17 may be provided to a valve lifter corresponding to the exhaust cam 13. In this case, the shaft drive mechanism 15 is provided to the exhaust cam shaft 13, and the exhaust cam shaft 13 can axially move.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A follower mechanism for transmitting movement of a three-dimensional cam to a valve, wherein the cam has a cam surface for driving the valve, the cam surface having a profile that varies in the axial direction of the cam, the follower mechanism comprising:

a valve lifter arranged between the cam and the valve to transmit movement of the cam to the valve;

a guide groove extending perpendicular to the axis of the cam and provided on the valve lifter, wherein the guide groove is defined by a retainer surface that has an arcuate cross-section; and a cam follower retained in the guide groove to engage the cam surface, wherein the cam follower pivots about a pivot axis and has an arcuate surface that contacts the retainer surface of the guide groove, wherein the arcuate surface includes a outer tapered surface, which is tapered relative to the pivot axis at an angle less than 90 degrees, wherein the retainer surface includes an inner tapered surface corresponding to the outer tapered surface of the cam follower, and wherein movement of the cam follower is restricted in a direction of the pivot axis by contact between the outer tapered surface and the inner tapered surface.

2. The follower mechanism according to claim 1, wherein the radius of the outer tapered surface decreases from the center of the cam follower toward the nearest end of the cam follower.

3. The follower mechanism according to the claim 1, wherein the outer tapered surface is a first outer tapered surface, and wherein the arcuate surface includes a second outer tapered surface, wherein the arcuate surface is radially enlarged at mid portion of the cam follower, wherein the enlargement is defined by the first and second outer tapered surfaces.

4. The follower mechanism according to claim 3, wherein the arcuate surface includes a semi-cylindrical surface.

5. The follower mechanism according to claim 1, wherein the outer tapered surface is a first outer tapered surface, and wherein the arcuate surface includes a second outer tapered surface, wherein the arcuate surface is radially enlarged at each of two opposite ends and radial enlargement is defined by one of the first and second outer tapered surfaces.

6. The follower mechanism according to claim 5, wherein the arcuate surface includes a semi-cylindrical surface.

7. The follower mechanism according to claim 1, wherein the outer tapered surface inclines relative to the pivot axis at at angle from 10 degrees to 70 degrees.

8. A valve drive device of an engine, the valve drive device comprising:

a camshaft rotatably supported by the engine;

a three-dimensional cam provided on the camshaft to selectively open and close the valve, wherein the cam has a cam surface for driving the valve, the cam surface having a profile that varies in the axial direction of the cam;

a valve lifter arranged between the cam and the valve to transmit movement of the cam to the valve;

a guide groove extending perpendicular to the axis of the cam and provided on the valve lifter, wherein the guide groove is defined by a retainer surface that has an arcuate cross-section;

a cam follower retained in the guide groove to engage the cam surface, wherein the cam follower pivots about a pivot axis, which extends perpendicular to the axis of the cam, wherein the cam follower has a flat surface that contacts the cam surface and an arcuate surface that contacts the retainer surface of the guide groove, wherein the arcuate surface includes an outer tapered surface, which is tapered relative to the pivot axis at an angle less than 90 degrees, wherein the retainer surface includes an inner tapered surface corresponding to an outer tapered surface of the cam follower, and wherein movement of the cam follower is restricted in a direction of the pivot axis by contact between the outer tapered surface and the inner tapered surface; and a driver for moving the cam axially to change the lift amount of the valve, wherein the axial movement of the cam changes the position of the cam surface with respect to the cam follower.

9. The valve drive device according to claim 8, wherein the radius of the outer tapered surface decreases from the center of the cam follower toward the nearest end of the cam follower.

10. The valve drive device according to claim 8, the outer tapered surface is a first outer tapered surface, and wherein the arcuate surface includes a second outer tapered surface, wherein the arcuate surface is radially enlarged at mid portion of the cam follower, wherein the enlargement is defined by the first and second outer tapered surfaces.

11. The valve drive device according to claim 10, wherein the arcuate surface includes a semi-cylindrical surface.

12. The valve drive device according to claim 8, wherein the outer tapered surface is a first outer tapered surface, and wherein the arcuate surface includes a second outer tapered surface, wherein the arcuate surface is radially enlarged at each of two opposite ends and radial enlargement is defined by one of the first and second outer tapered surfaces.

13. The valve drive device according to claim 12, wherein the arcuate surface includes a semi-cylindrical surface.

14. The valve drive device according to claim 8, wherein the outer tapered surface inclines relative to the pivot axis at an angle from 10 degrees to 70 degrees.

* * * * *

UNITED STATES PATENT AND TRADEMARK OFFICE

CERTIFICATE OF CORRECTION

PATENT NO. : 6,164,256
DATED : December 26, 2000
INVENTOR(S) : Shuuji Nakano et al.

It is certified that error appears in the above-identified patent and that said Letters Patent is hereby corrected as shown below:

Title Page,
Line [73] Assignee, change the address from "Tokyo, Japan" to --Toyota, Japan--.

Signed and Sealed this

Third Day of July, 2001

*Attest:*

Nicholas P. Godici

*Attesting Officer*

NICHOLAS P. GODICI
*Acting Director of the United States Patent and Trademark Office*